United States Patent [19]

Davis, Jr. et al.

[11] 4,105,163

[45] Aug. 8, 1978

[54] FUEL NOZZLE FOR GAS TURBINES

[75] Inventors: Lewis Berkley Davis, Jr., Schenectady; Colin Wilkes, Scotia, both of N.Y.

[73] Assignee: General Electric Company, Schenectady, N.Y.

[21] Appl. No.: 736,159

[22] Filed: Oct. 27, 1976

[51] Int. Cl.[2] ..... B05B 7/10

[52] U.S. Cl. ..... 239/406; 60/39.74 R; 431/9

[58] Field of Search ..... 239/405, 406; 431/9; 60/39.74 R

[56] References Cited

U.S. PATENT DOCUMENTS

| | | | |
|---|---|---|---|
| 2,658,800 | 2/1951 | Collinson | 239/406 X |
| 2,812,212 | 11/1957 | Rogers et al. | 239/405 X |
| 3,758,258 | 9/1973 | Kohli | 431/9 |
| 3,768,250 | 10/1973 | Kawaguchi | 60/39.74 R |
| 3,886,736 | 6/1975 | Kawaguchi | 239/406 X |
| 3,946,552 | 3/1976 | Weinstein et al. | 239/406 X |

*Primary Examiner*—Joseph F. Peters, Jr.
*Assistant Examiner*—Michael Mar
*Attorney, Agent, or Firm*—Jerome C. Squillaro

[57] ABSTRACT

A fuel nozzle for use with gas turbines includes a centrally disposed orifice for discharging fuel into a combustion chamber. A first annular passage surrounds the fuel orifice and discharges primary air adjacent the exit of the fuel orifice for effecting atomization of the fuel and mixture of the air with the fuel to provide a fuel/air spray having a predetermined spray angle. A second annular passage for supplying secondary air is provided surrounding the first passage. This second passage is formed to supply air in a manner which creates a relatively low pressure substantially at the base of the fuel/air spray. When operating at the low fuel flow rates corresponding to low loads, air is supplied only through the first air passage and a relatively narrow spray angle, with a substantial concentration of fuel, is achieved. In a specific embodiment, as the load increases secondary air is supplied with a swirling motion through the second or outer annular passage and creates a vortex of rotating air flow, resulting in a reduction in static pressure at the base of the spray formed by the mixture of fuel and primary air. The reduction in pressure at the base of the spray causes the spray angle to be increased and enhances fuel and air mixing. This improves combustion and reduces smoke emission. In other embodiments, if desired, secondary air may be supplied at any fuel flow rate to provide the optimum spray angle for any given condition. The spray angle is controllable independently of the fuel flow rate.

2 Claims, 2 Drawing Figures

FUEL NOZZLE FOR GAS TURBINES

BACKGROUND OF THE INVENTION

1. Field of the Invention

This invention relates to gas turbines and more particularly to fuel nozzles used with such turbines.

2. Description of the Prior Art

It is desirable for economy purposes to use residual fuels for gas turbines since they are less expensive than distillate fuels. However, residual fuels behave differently than distillate fuels with respect to smoke performance and present particular problems when the turbine must operate within prescribed smoke limits over widely varying loads.

Single shaft gas turbines employed for power generation must operate at constant speed, and thus constant airflow rate, over a widely varying load range. The gas turbines are, therefore, required to operate over a relatively wide range of fuel/air ratios. If the stoichiometry of a combustor is designed for low smoke operation at high load, the combustor must then operate at a very lean primary zone fuel/air ratio at no load. With residual fuel, the primary zone then becomes so lean that the combustion reaction is quenched too early. The temperature does not become high enough, combustion efficiency is low, and the smoke-forming carbon particles are not fully consumed.

This problem of a too lean fuel/air ratio at no load can, of course, be overcome by increasing the fuel/air ratio in the primary zone at no load. However, in that case the primary zone operates in an over-rich condition at higher loads, resulting in an unsatisfactory smoke performance at higher loads.

Various approaches have been taken by the prior art in an attempt to provide satisfactory combustion, and thus smoke performance, with varying fuel flow rates. In one prior art approach two fuel passages are employed in a pressure atomizing nozzle, one having a high pressure drop and the other a low pressure drop. Using the higher pressure drop passage at low fuel flow rates obtains good atomization and combustion efficiency. The lower pressure drop passage opens at increased fuel flow requirements. However, pressure atomizing nozzles are not generally suitable for residual fuels because the high fuel viscosity requires very high fuel nozzle pressures. In particular, the pressure drop at full load when using the high pressure drop passages would be prohibitively high. Air atomizing nozzles, which rely on the interaction of a fuel and air stream to atomize the fuel, have more moderate fuel pumping requirements and so are better suited to use with high viscosity fuels.

In a standard air atomizing nozzle air is used to atomize the fuel. The amount of air employed is customarily independent of the fuel flow rate. At low fuel flow rates the angle of the spray cone is relatively small. As the fuel flow rate increases, the cone "opens up", providing a wider spray angle. As the fuel rate increases further, the downstream end of the cone closes back down.

The present invention provides a means for controlling the spray cone without changing the fuel flow rate so that at any fuel flow rate, control of the spray angle of the cone is provided. The application for which the nozzle of this invention is particularly useful, namely the burning of residual fuel, uses the advantageous characteristics of the nozzle to reduce smoke emission at higher loads in a combustion system which has satisfactory smoke performance at lower loads. It will become apparent as the description of the invention proceeds that it may also be advantageously employed in other combustion systems which have smoke emission problems in, for example, the low or mid-load range. In such other systems control of the spray angle may be effected in a manner appropriate to the requirements of the particular system, using the nozzle structure of the present invention.

The prior art includes a fuel nozzle for gas turbines, shown in U.S. Pat. No. 2,658,800 — Collinson, for varying the spray angle under different working conditions. Collinson does not discuss what these different working conditions are nor the relationship of the spray angle to particular working conditions. In Collinson's structure the fuel is delivered through an annular orifice and separate air supply passages are provided, one disposed inwardly and the other disposed outwardly of the annular fuel delivery orifice. The air from the two air supply passages impinges on opposite sides of the liquid fuel jet and the spray angle is varied by varying the relative rates of supply of air through the two passages. In the applicants' structure, as will be described in more detail later in the specification, the fuel is delivered through a central passage and both the primary air passage and the secondary air passage are arranged outwardly of the fuel passage. The primary air is employed for initial mixing of fuel and air and establishes a predetermined spray angle at a particular fuel flow rate, such as at low load. The spray angle is then increased by providing secondary air through an annular passage outwardly of the primary air passage in a manner which creates a region of lower pressure substantially at the base of the fuel/air spray. This provides a simpler and substantially more effective arrangement for accurately controlling the spray angle than the nozzle structure of Collinson where the variation of the spray angle is obtained by varying the amount of air impinging on opposite sides of the liquid fuel jet.

The prior art discloses an arrangement, shown in U.S. Pat. No. 3,758,258 — Kohli, in which the spray angle is increased by creating a low pressure zone near the base of the spray. In Kohli this low pressure zone is created by directing a jet of air outwardly away from the fuel-/air spray at a particular angle or by applying suction to a ring surrounding the base of the fuel/air spray. However, the Kohli nozzle operates in a different manner from that of the applicants where, as will be explained in detail later, the low pressure region is created by supplying the secondary air in a swirling manner generally axially of the nozzle rather than outwardly. Moreover, the Kohli disclosure is not directed in any way toward varying the spray angle in accordance with changes in fuel flow rate and thus load so as to obtain consistently good smoke performance under varying conditions, nor is it concerned with controlling the spray angle independently of the fuel flow rate.

In accordance with the present invention, it has been found that improved smoke performance of a gas turbine combustor using residual fuels can be obtained over a wide range of loads by arranging the supply of air to the fuel nozzle in such a manner that the spray angle of the fuel/air mixture may be varied for different loads and may be varied independently of the fuel flow rate. Moreover, this improvement in residual fuel smoke performance is achieved without adversely affecting the smoke performance of the gas turbine when distillate fuels are used.

It is therefore an object of this invention to provide improved smoke performance of gas turbines utilizing residual fuels.

It is another object of this invention to provide improved smoke performance of gas turbines using residual fuels over a wide range of loads from no load to full load.

It is still another object of this invention to provide improved smoke performance of gas turbines using residual fuels without adversely affecting smoke performance when using distillate fuels.

It is a further object of this invention to provide improved ignition capability and improved lean blow-out performance in gas turbines.

It is a further object of this invention to vary the spray angle independently of the fuel flow rate.

SUMMARY OF THE INVENTION

In carrying out the invention, in one form thereof, a fuel nozzle is provided which includes a centrally disposed orifice for discharging fuel into a combustion chamber. A first annular passage surrounds the fuel orifice and discharges primary air adjacent the exit of the fuel orifice for effecting atomization of the fuel and mixture of the air with the fuel to provide a fuel/air spray having a predetermined spray angle. A second annular passage for supplying secondary air is provided surrounding the first passage. This second passage is formed to supply air in a manner which creates a relatively low pressure substantially at the base of the fuel/air spray. When operating at the low fuel flow rates corresponding to low loads, air is supplied only through the first air passage and a relatively narrow spray angle, with a substantial concentration of fuel, is achieved. In a specific embodiment, as the load increases secondary air is supplied with a swirling motion through the second or outer annular passage and creates a vortex of rotating air flow, resulting in a reduction in static pressure at the base of the spray formed by the mixture of fuel and primary air. The reduction in pressure at the base of the spray causes the spray angle to be increased and enhances fuel and air mixing. This improves combustion and reduces smoke emission. In other embodiments, if desired, secondary air may be supplied at any fuel flow rate to provide the optimum spray angle for any given condition. The spray angle is controllable independently of the fuel flow rate.

DESCRIPTION OF THE DRAWINGS

The invention may be better understood by reference to the accompanying drawing, in which.

DESCRIPTION OF THE PREFERRED EMBODIMENT

Figure 1:
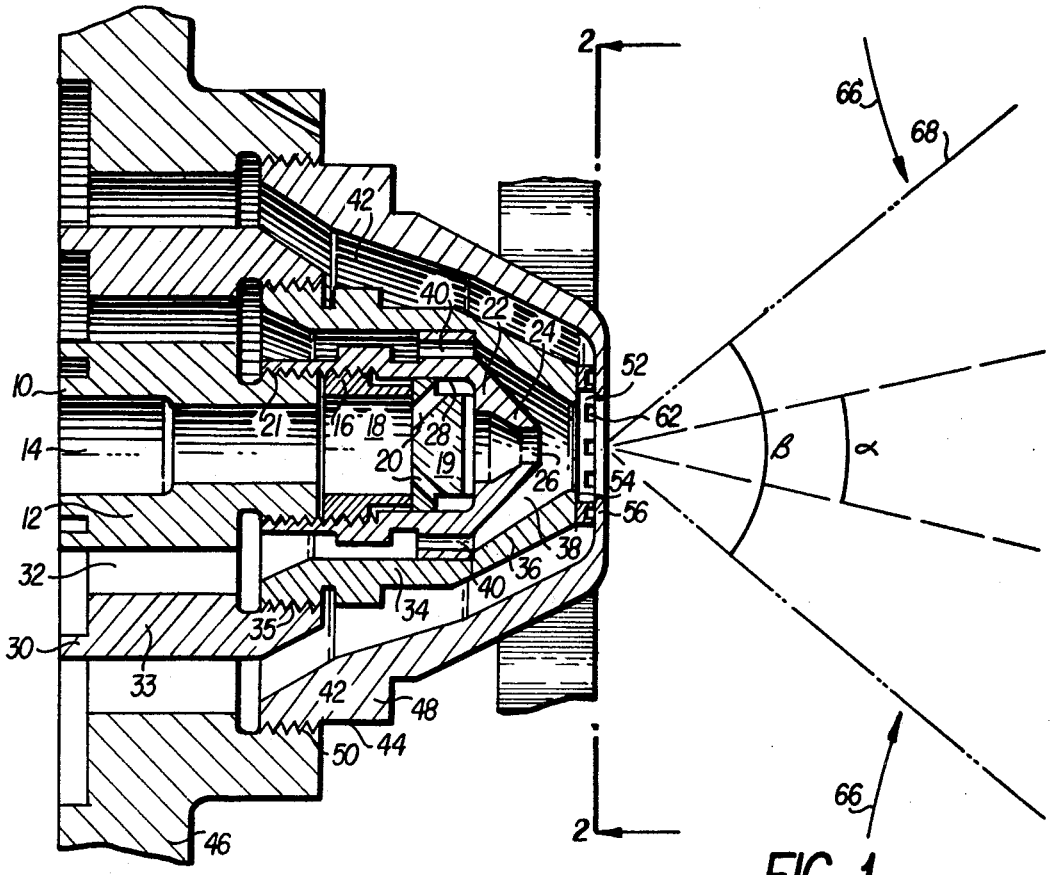
FIG. 1 is a sectional view of a fuel nozzle incorporating an embodiment of this invention.

Referring now to the drawing, there is shown, in one embodiment thereof, the fuel nozzle of this invention. The nozzle includes a generally cylindrical elongated central body portion designated by the numeral 10 in the drawing. This body portion includes a rear element 12 having an axial passage 14 therein, an intermediate element 16 having a central axial passage 18, aligned with the passage 14, and a forward element 19 having a plurality of angularly extending passages 20. The elements 12 and 16 are threaded externally along a portion thereof, as indicated at 21.

Surrounding the elements 16 and 19 and a portion of the element 12 is a hollow elongated member 22. The member 22 includes an internally threaded portion arranged for engagement with the externally threaded portions of elements 12 and 16 to retain elements 12, 16 and 19 in assembled relationship. The member 22 is provided with a cone-shaped forward end 24 which terminates in a central opening or orifice 26. The element 19 is formed to provide an annular space 28 between this element and the member 22 adjacent the forward ends of the passages 20. This annular space communicates with the orifice 26.

Fuel is supplied from any suitable source through a line (not shown) connected in any suitable manner to the axial passage 14. This fuel is directed through the aforementioned passages 14, 18 and 20 to the orifice 26.

In order to provide for the supply of primary air for mixture with the fuel to provide a fuel/air spray, the nozzle is formed to include a generally annular member 30 surrounding and generally concentric with the central body portion 10 and spaced therefrom to provide a generally annular passage 32 therebetween. The member 30 is formed of a rear element 33 and a forward element 34 held in threaded engagement at 35. The member 30 is arranged in assembled relationship with the member 22. At its rear portion the passage 32, which has been termed generally annular for convenience of description, actually comprises a plurality of circular passages arranged in annular configuration, but the plurality of passages join at the forward end in a true annular passage. Hence, for convenience, it is being referred to throughout as an annular passage.

The annular passage 32 is arranged to be connected to any suitable source of air under pressure for supplying primary air to mix with the fuel from the orifice 26 to form a fuel/air spray. In order to effect such mixture, the forward end of the member 30 is generally cone-shaped, as indicated at 36, so that the passage 32 is inwardly inclined at its forward end, preceding a discharge opening 38 thereof. Air between the forward cone-shaped portion 36 and the member 22 is directed toward the fuel being discharged from the orifice 26 to effect mixture of the fuel and primary air to form the fuel/air spray. In order to provide for passage of air from rear portion of the annular passage 32 to the discharge opening 38 adjacent the fuel discharge ofifice, a plurality of passages 40 are provided in the member 22, these passages being concentrically arranged about the axis of the nozzle.

The air discharged through the discharge opening 38 assists in atomizing the fuel discharged through the orifice 26 and mixes with the fuel to provide a fuel/air spray having a predetermined angle indicated by the angle $\alpha$ in FIG. 1. The fuel and primary air proportions are selected so that the angle $\alpha$ is sufficiently small to provide a burning zone with the proper stoichiometry for smoke free combustion. The mixture of fuel and air is such that the temperature becomes sufficiently high that smoke-forming carbon particles are fully consumed. This is especially important in the use of residual fuels, with which the nozzle of this invention is particularly useful, because such fuels tend, more than distillate fuels, to have unconsumed smoke-forming carbon particles at lower temperatures. Moreover, the mixture is sufficiently rich to insure against lean blow-out and to achieve improved ignition capability.

Heavy duty gas turbines, with which this invention is particularly advantageously employed, operate at constant speed so that the combustor airflow rate is constant. Thus, the amount of air entering the burning zone is constant. At low loads a small amount of fuel is mixed with a relatively large amount of air. Thus, the fuel/air ratio in the burning zone is relatively low but sufficiently high to insure against lean blow-out and to achieve good ignition capability. The combustor may be readily designed to provide satisfactory smoke performance under these load conditions. As the gas turbine is loaded and fuel flow rate therefore increases the fuel/air mixture in the burning zone would become unduly rich, resulting in deteriorating smoke performance. Thus, in the operation of the prior art nozzles when the fuel/air ratio, utilizing residual fuels, was adequate to avoid unsatisfactory smoke performance at no load, the fuel/air ratio became over-rich at higher loads because of the substantial increase in fuel supplied. This had resulted in unsatisfactory smoke performance at higher loads.

In accordance with this invention, this unsatisfactory condition at higher loads is avoided by providing, in a particular manner, additional air to the fuel/air spray mixture under increased load conditions. The invention is particularly directed to an arrangement for controlling the spatial distribution of fuel in the burning zone. This is accomplished by changing the spray angle, and thus changing the volume occupied by the fuel spray, even while the fuel flow rate is maintained constant so that improvement in combustion efficiency and reduced smoke emission can be obtained over a wide range of loads. For example, at higher loads an increase in the spray angle increases the volume of the fuel spray so as to bring the fuel into contact with a greater portion of the combustion air entering the burning zone of the combustor.

More specifically, in the embodiment of the invention disclosed in the drawing, a second annular passage 42 for supply of air is provided surrounding and generally concentric with the first annular passage 32. This second passage 42 is provided by means of a member 44 which includes a section 46 at the rear of the nozzle, mounted in any suitable manner in the combustion chamber, and a section 48 at the forward end of the nozzle. The sections 46 and 48 are arranged in screw-threaded engagement, as indicated at 50. The forward section 48 is of generally conical shape and is spaced from the corresponding cone-shaped portion 36 of the member 30 to form an inwardly inclined forward end of the second annular passage 42 outwardly of the discharge opening 38 of passage 32. Air is supplied to the rear end of the passage 42 from any suitable source and is discharged at the forward end of the passage 42 generally adjacent the base of the spray formed by the mixture of fuel supplied through the orifice 26 and primary air supplied through the discharge opening 38. The secondary air is discharged from the passage 42 as an inwardly directed swirling flow which establishes a relatively low pressure at the base of the fuel/air spray and causes the angle of the spray to be increased. At full load the air supplied through the passage 42 causes this angle to be increased substantially, to the angle indicated by $\beta$ in FIG. 1.

Figure 2:
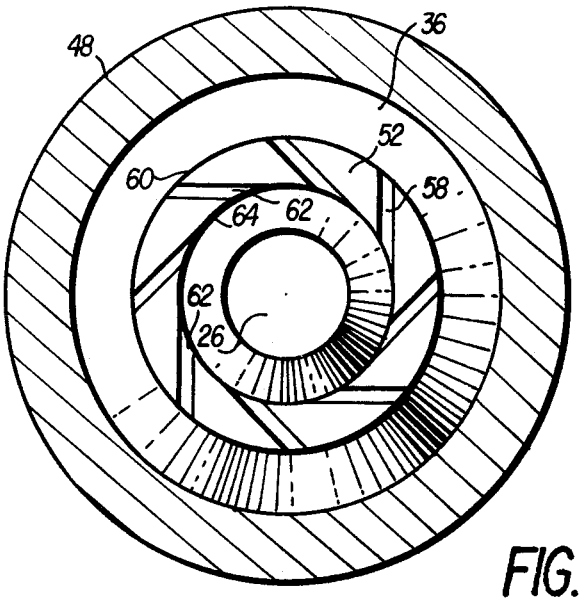
FIG. 2 is an enlarged sectional view taken along the line 2—2 in FIG. 1.

In order to establish the inwardly directed swirling flow at the base of the spray, an annular member 52 is positioned between the forward edge of the cone-shaped portion 36 and an inwardly extending lip 56 at the forward end of the section 48 of the member 44. As best shown in FIG. 2, the annular member 52 is formed to include a plurality of slots or passages 58 extending in a direction generally tangential to the discharge opening 38 of the first annular passage 32. Each of these passages 58 is arranged to receive secondary air from the passage 42 at one end 60 thereof and to discharge this air at the other, or inner, end 62 of each passage in a direction generally tangential to the discharge opening formed by the inner wall 64 of the annular member 52. This causes the secondary air discharging from the passage 42 to be given a swirling motion, creating a vortex in this area and developing a region of relatively low pressure substantially at the base of the fuel/air spray. The development of this region of low pressure causes the angle of the fuel/air spray to be increased because of the tendency of the fuel/air mixture at the boundary of the spray to move into this region of lower pressure. This increase in spray angle causes a more complete mixing of the fuel and the air in the combustor. This is because the normal gas turbine combustion air, indicated generally by the arrows 66, is provided from openings in the outer wall of the combustion chamber beyond the forward end of the nozzle. With the larger spray angle resulting from the nozzle structure employed in this invention, this combustion air is further mixed with the fuel/air spray, for example, in the region indicated by the numerals 68, insuring more complete combustion under higher load conditions and substantial elimination of smoke, even when using residual fuels.

In one specific fuel nozzle construction in accordance with this invention the fuel/air spray at no load had an angle $\alpha$ of 73°. At full load, with a fuel flow rate of 1500 pounds/hour the spray angle was increased to 116°.

In one form of this invention, it is contemplated that a single atomizing air supply line will be provided. Under no load conditions all of the air supplied would be directed through the first annular passage 32. As the load increases, a valve provided in the atomizing air supply line would cause an increasing proportion of the air to be diverted to the second annular passage 42. It has been found that with the fuel nozzle structure of this invention even where, because of other gas turbine design considerations, the total amount of air supplied must be relatively constant and an increasing proportion is diverted to the outer or secondary air passage, with a corresponding decrease in the amount of primary air, improved smoke performance can still be achieved. It will be understood, of course, that in gas turbines not having this design limitation, the original amount of primary air supplied through the first, or inner, annular passage 32 could be continued unchanged and additional air, in increasing amounts, could be supplied through the second, or outer, annular passage 42. This would enable achievement of still further improvement in the performance of the gas turbine.

The nozzle structure of this invention provides effectively for improved smoke performance of gas turbines over a wide range of loads from no load to full load even when using residual fuels. At no load a fuel/air mixture is provided which is of proper stoichiometry to avoid lean blow-out and achieve good ignition capability, and, moreover, which insures operation at a sufficiently high temperature to provide good smoke performance at no load, even when using residual fuels. With the structure of this nozzle additional air is provided in a manner which prevents an over-rich condition at higher loads ranging up to full load and which automatically and effectively increases the fuel/air spray angle as the load increases. Further, this is accomplished in a simple manner and with a structure which does not tend to cause undue erosion of any part of the nozzle.

The above detailed description has been directed specifically to a condition where the main objective is to reduce smoke emission at higher loads in a gas turbine which has satisfactorily low smoke emission at lower loads. However, it will be understood, particularly since the spray angle using this nozzle may be varied independently of the fuel flow rate, that under other situations where smoke emission problems occur at low or mid-load range, spray angle control appropriate to such other situations may similarly be effected by appropriate variation in the flow rate of the secondary air.

While a particular nozzle structure for carrying out the invention has been shown and described, it is not intended that the claims be limited to the particular structure shown and described, but rather it is intended that the claims cover such modifications as come within the spirit and scope of this invention.

We claim:

1. A fuel nozzle for a gas turbine comprising:

a. a central passage for supply of fuel, said passage terminating in an orifice for discharge of fuel;

b. a first annular passage generally surrounding and concentric with said central passage for supply of primary air, said first annular passage having a discharge opening surrounding said orifice and causing air supplied through said first annular passage to be mixed with fuel to provide a conical fuel/air spray having a predetermined spray angle; and c. a second annular passage for supply of secondary air, said second annular passage surrounding and generally concentric with said first annular passage and having a discharge opening surrounding said first annular passage discharge opening, d. an annular member disposed in said discharge opening of said second annular passage; and e. said annular member having formed therein a plurality of circumferentially spaced slots, said slots being arranged so as to deliver said secondary air therethrough as a plurality of streams tangentially disposed to said first annular passage discharge opening and in a plane generally normal to the axis of said first annular passage, whereby said secondary air is delivered substantially at the base of said fuel/air spray to develop a low pressure substantially at the base of said fuel/air spray and thereby effect an increase in said spray angle as the spray cone is developed.

2. The fuel nozzle of claim 6, wherein:

a. air is supplied entirely through said first annular passage at no load; and b. wherein air is supplied through said annular passage to increase said spray angle as the load on the gas turbine increases.

* * * * *